United States Patent [19]

Vajtay

[11] 4,215,779

[45] Aug. 5, 1980

[54] TUBULAR PACKAGE FOR FRAGILE OBJECTS

[76] Inventor: Leslie Vajtay, 107 Stanford Ave., Colonia, N.J. 07067

[21] Appl. No.: 15,101

[22] Filed: Feb. 26, 1979

[51] Int. Cl.[3] ..... B65D 85/42

[52] U.S. Cl. ..... 206/421; 206/485

[58] Field of Search ..... 206/422, 418, 419, 421, 206/485, 588; 229/39 B

[56] References Cited

U.S. PATENT DOCUMENTS

| | | | |
|---|---|---|---|
| 1,226,733 | 5/1917 | Whitney | 206/421 |
| 1,865,268 | 6/1932 | Morris | 229/39 B |
| 2,191,506 | 2/1940 | Snyder | 206/421 |
| 2,205,437 | 6/1940 | Ringler | 206/422 |
| 2,451,806 | 10/1948 | Carson | 229/16 D |
| 2,593,689 | 4/1952 | Mitchell | 229/39 B |
| 2,619,227 | 11/1952 | Arthur | 206/419 |
| 3,048,323 | 8/1962 | Stauffer | 206/418 |
| 3,255,879 | 6/1966 | Paige | 229/39 B |
| 3,913,774 | 10/1975 | Vajtay | 220/4 R |
| 3,986,659 | 10/1976 | Vajtay | 220/4 R |

FOREIGN PATENT DOCUMENTS

| | | | |
|---|---|---|---|
| 149734 | 1/1953 | Australia | 206/418 |
| 153747 | 10/1953 | Australia | 206/418 |
| 719191 | 11/1931 | France | 206/418 |
| 294536 | 2/1954 | Switzerland | 206/421 |
| 403627 | 6/1966 | Switzerland | 206/422 |

*Primary Examiner*—Herbert F. Ross

[57] ABSTRACT

Disclosed is a tubular package for fragile objects having a central section formed from a semi-rigid thermoplastic material and end caps joined to each end of the tubular central section. The end caps have spacing means extending beyond the outer periphery of the central sections for preventing contact between central sections when a plurality of such packages are placed adjacent to each other. Openings in the end caps permit the fragile objects to protrude from the package.

3 Claims, 6 Drawing Figures

TUBULAR PACKAGE FOR FRAGILE OBJECTS

CROSS-REFERENCES TO RELATED APPLICATIONS AND PATENTS

1. L. Vajtay, U.S. Pat. No. 3,913,774, issued on Oct. 21, 1975 for "End Caps For Containers".

2. L. Vajtay, U.S. Pat. No. 3,986,659, issued on Oct. 19, 1976 for "End Caps For Tubular Containers".

3. L. Vajtay, application Ser. No. 912,839, filed June 5, 1978, for "Thermoplastic Container".

BACKGROUND OF THE INVENTION

1. Field of the Invention

This invention relates to tubular packages for fragile objects and more particularly to an improved package for light bulbs, Christmas ornaments, and the like.

2. Description of the Prior Art

The above referenced patent application and patents describe a class of containers having flexible or semi-rigid tubular central sections and relatively rigid end caps. The central sections are normally a thermoplastic material approximately 0.010 to 0.050 inches in thickness and manufactured in the form of a tube. It is known to form a central section as an endless thermoplastic sleeve which is subsequently cut to length, depending on the desired height of the package.

As previously described in the cross-references, various end caps have been found useful, depending on the particular application. Rigid end caps provide shape and rigidity to relatively flexible central sections. Of course, as the central sections become more rigid, relatively less rigid end caps become suitable. Similarly, in case the package contents contributes to the shaping and rigidity of the tubular central section, relatively less rigid end caps become suitable. Nevertheless, in the case of end caps as described in my cross-referenced U.S. Pat. Nos. 3,913,774 and 3,986,659, the end caps should be rigid relative to the flexible or semi-rigid tubular central sections.

Although the cross-references describe tubular containers which have enjoyed tremendous success, certain applications demand further improvements. For example, certain objects such as light bulbs could advantageously utilize a package from which they can protrude. The protrusion of the socket end permits electrical testing while protrusion of the other end permits viewing of electrical data, etc. As another example, Christmas ornaments could be viewed without obstruction, have their texture felt by prospective purchasers etc. Eventhough the tubular central sections are usually transparent, this additional product exposure is an added advantageous feature that has not been suggested by the known prior art.

A further weakness in the prior art has resulted from packing a case full of tubular packages containing fragile objects. The resultant contact and rubbing of adjacent central sections has caused scuffing and other damage. The known prior art has also failed to address or solve this last mentioned problem.

SUMMARY OF THE INVENTION

Accordingly, it is a primary object of this invention to provide an improved end cap for a tubular central section.

It is another object of this invention to provide an improved tubular package for fragile objects permitting access through the end caps.

It is a still further object of this invention to prevent scuffing and other damage to adjacently packed tubular packages.

Lastly, it is an object of this invention to package one or more fragile objects in a tubular container.

In accordance with the present invention, an improved tubular container for fragile objects is provided. A tubular central section is preferably formed from a thermoplastic flexible or semi-rigid sheet material having a thickness in the order of 0.010 to 0.050 inches. The sheet material may be folded flat, forming a pair of creases, and adhesively or thermally joined along a longitudinal seam, forming endless sleeves. It can then be cut to length depending on the desired height of the resultant container. If a package having a round cross-section is desired, the pair of creases can be eliminated by a heat treatment—or merely minimized by the use of a relatively rigid round end cap. If a package having a polygon shaped cross-section is desired, additional creases may be formed in the material constituting the tubular central sections.

End caps attached at both ends of the tubular central section complete the package. For the purposes of the present invention, end caps can be joined to the tubular central section in a number of known ways. For joining relatively rigid end caps to the tubular central sections, the teachings of the cross-references are uniquely adapted for use with my present invention.

In accordance with one aspect of my invention, I provide end caps with openings in contact with the packaged fragile object. In the case of a light bulb, this permits the protrusion of the socket for testing purposes. Alternatively, the other end of the light bulb could protrude for visual inspection.

In accordance with another aspect of my invention, buffering means such as spacers are provided between several fragile objects in a tubular package. This prevents potential damage that might result if such fragile objects are permitted to contact each other.

In accordance with a still further aspect of my invention, the end caps are provided with spacing means extending beyond the outer periphery of the tubular central section. This prevents contact between the tubular central sections of adjacently packed packages. Contact has been found to be highly undesirable because it can cause scuffing and other damage. Contact between adjacent end caps causes no damage.

The above mentioned objects, features and advantages of theinvention, together with others inherent in the same, are attained by the embodiments illustrated in the drawings, the same being merely preferred exemplary forms, and are described more particularly as follows.

IN THE DRAWINGS

DETAILED DESCRIPTION

Figure 1:
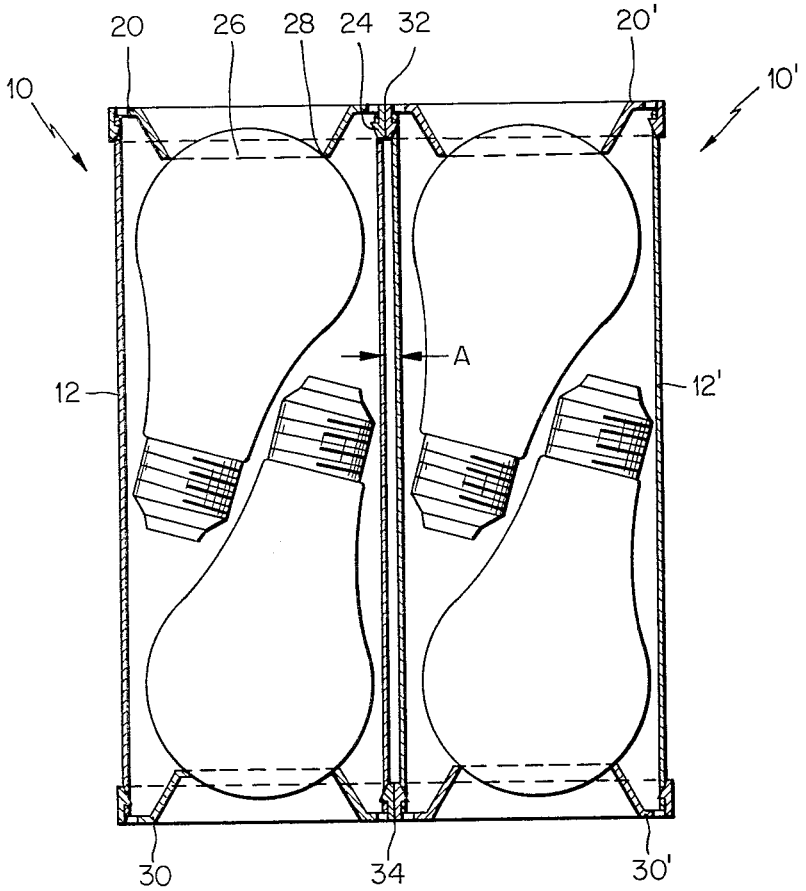
FIG. 1 is a schematic side view of two adjacently packed tubular packages containing fragile objects.

Referring to FIG. 1, containers 10 and 10' include tubular central sections 12 and 12', and end caps 20, 20' and 30, 30'. Note that tubular central sections 12 and 12' are separated from each other by distance A. This feature is obtained by thickening the end caps at points e.g., 32 and 34, thereby providing spacers integral therewith. Such integral spacers, in the case of molded end caps, are formed by thickening the return wall sufficiently to create a separation between the tubular central sections. In case the return wall is thermoformed, it can be shaped like a skirt, separated from the tubular central section, in order to provide integral spacers.

The illustrated end caps, e.g., 20, have arrow-head shaped protrusions 22 and 24, etc. which protrude through corresponding perforations in central section 12, thereby interlocking the end caps and tubular central sections. The details of such interconnections are described in detail in the cross-references and need not be repeated herein. Suffice it to say that in an alternate case where the depending portion of end cap 20 is internal to central section 12 (with the arrow-head pointing outwardly from the container) then a piece of end cap 20 would still have to be extended beyond the outer periphery of the central section. The actual thickness of the spacer will depend on the height of the containers and the anticipated flexing of the tubular central sections.

A significant aspect of my present invention is illustrated by the circular opening 26 in end cap 20. Note that continuous contact is made along edge 28, thereby securely holding the fragile object—in this case a light bulb. The fragile object is thus exposed through the opening. The other end caps 30, 30' and 20' are similarly constructed. The flexible sides of tubular central section 12 and 12' are uniquely adapted to hold fragile objects, such as those illustrated.

Figure 2:
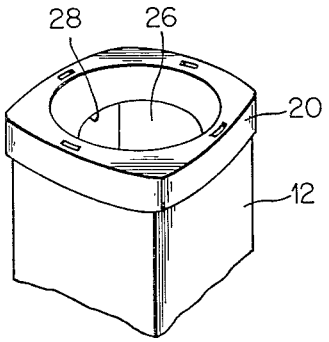
FIGS. 2 and 3 are perspective views showing various end cap configurations.

Referring now to FIG. 2, end cap 20 is illustrated with an exemplary external shape. Central section 12 has the same cross-sectional shape. Rim 28 of opening 26 should be round for sphere-like fragile objects. The dimension and shape of opening 26 must, however, be contoured to match the particular fragile object.

Figure 3:
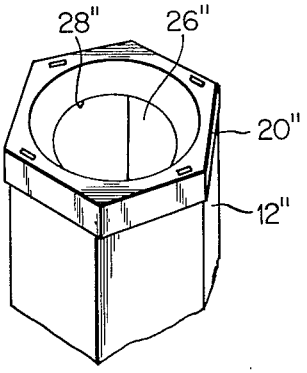

Referring now to FIG. 3, end cap 20'' is shown as a hexagon. Tubular central section 12'' has the same cross-sectional shape. Opening 26'' with rim 28'', however, remains contoured to contain a sphere-like object such as a light bulb.

Figure 4:
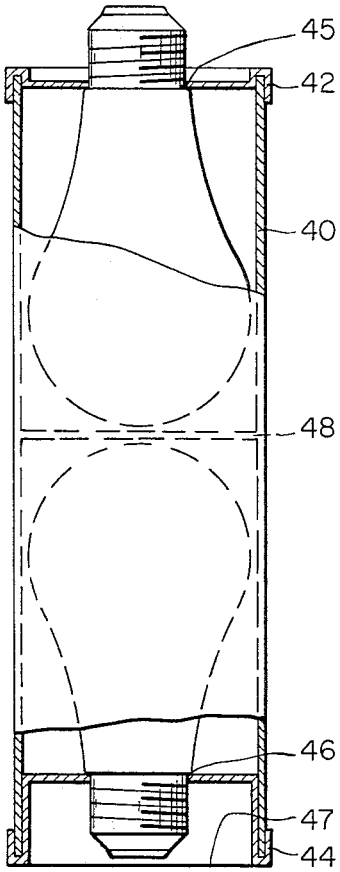
FIG. 4 is a schematic side view of another embodiment.

Refer now to FIG. 4 for an alternate embodiment where the sockets rather than the tops of the light bulbs protrude. Tubular central section 40 is provided with a pair of end caps 42 and 44 in the manner previously described. Here, the end caps are shown joined to the central section adhesively or with a friction fit. The upper bulb contacts rim 45 of an opening in end cap 42. The lower bulb contacts rim 46 of an opening in end cap 44. Note that end cap 44 is constructed to permit the standing of the package on a flat surface. This is accomplished by containing the lower light bulb entirely within the plane 47 defined by the lower extreme periphery of the package. This is contrary to the upper bulb which extends beyond the plane defined by the upper extreme periphery of the package. In place testing is possible at either end depending on the configuration of the test socket.

Another important feature illustrated in FIG. 4 is a spacer 48 formed from cardboard or other suitable material placed between the fragile objects. For example, it can be a small foam label that is pressure sensitive. This provides a buffer between the fragile objects, preventing damage. Any suitable alternate material, such as styrofoam, could be used. Note that buffer 48 is a flat piece cut in the cross-sectional shape of central section 40. This is inherently less expensive than a complex shaped buffer for wrapping the fragile objects.

Figure 5:
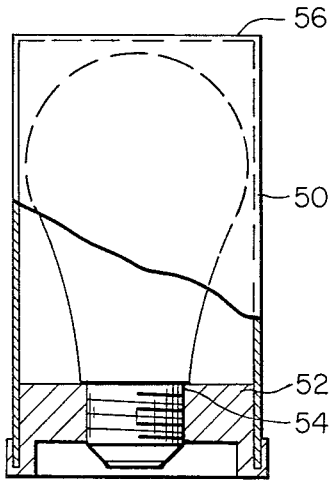
FIG. 5 is a schematic side view of still another embodiment.

Refer now to FIG. 5 which shows a tubular central section 50 and an end cap 52. In this case, rim 54 contacts substantial portions of the fragile object. As shown, the opening in end cap 52 is adapted to rigidly hold the socket protruding therethrough. Flat piece 56 can form the top of this container for a single fragile object. Preferably, consider piece 56 a suitable buffer to an identical upper half of the FIG. 5 illustration which can be considered a mirror image of the lower half of the illustrated package, for two fragile objects.

Figure 6:
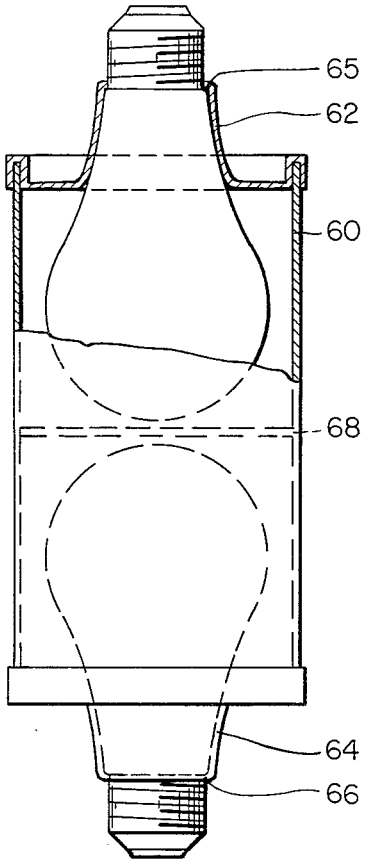
FIG. 6 is a schematic side view of a still further embodiment.

Referring now to FIG. 6, there is illustrated a still further embodiment which is a variation of the FIG. 4 embodiment. Tubular central section 60 has end caps 62 and 64. The protruding fragile objects contact the end caps not only at rim 65 and 66. Rather, each of the end caps is funnel shaped and substantially contoured to match the fragile objects. Buffer 68 prevents contact between the fragile objects.

While the fragile object most predominantly illustrated has been a bulb, those skilled in the art will recognize that other fragile objects could be similarly packaged. Also, with a suitable buffer, more than two fragile objects could be placed in a single package. Thus, while several examples illustrative of preferred embodiments have been described, those skilled in the art will recognize that various changes in the disclosed structures and exemplary methods may be made without departing from the spirit and scope of this invention.

I claim:

1. A tubular package containing a pair of light bulbs or the like, comprising:

a tubular section formed from a thermoplastic sheet material and having a cross-sectional dimension substantially equal to that of each of said pair of light bulbs, said light bulbs being axially aligned and placed end to end within said tubular section such that respective electrical sockets of said light bulbs are pointed in opposite directions;

a spacer cushion having the same cross-sectional dimension and shape as said tubular section placed between said light bulbs and in intimate contact therewith in a plane perpendicular to the longitudinal axis of said tubular section to prevent said light bulbs from contacting each other;

a pair of centrally apertured end caps, one at the rim of each end of said tubular section;

each said end cap having an annular cross-section in a plane perpendicular to the longitudinal axis of said tubular section, the outer periphery of said end caps being joined to respective rims of said tubular section, the inner periphery of said end caps contoured for frictionally engaging said light bulbs substantially at the juncture between the electrical socket and the remaining portion of said light bulbs such that said electrical sockets protrude through said end caps and extend outwardly beyond the rims of said tubular section to permit electrical testing.

2. A tubular package as in claim 1 wherein:

said tubular section is cylindrical having a cross-sectional shape and dimension substantially equal to that of each said pair of light bulbs.

3. A tubular package as in claim 1 wherein:

said tubular section has a longitudinal dimension less than the longitudinal dimension of said light bulbs placed end to end.

* * * * *